US006783601B2

(12) United States Patent
Gray et al.

(10) Patent No.: US 6,783,601 B2
(45) Date of Patent: Aug. 31, 2004

(54) METHOD FOR REMOVING PARTICLES AND NON-VOLATILE RESIDUE FROM AN OBJECT

(76) Inventors: Donald Gray, 9 McGraw Ct., Warwick, RI (US) 02818; Charlotte Fredrick, 1443 E. LaVieve La., Tempe, AZ (US) 85284

( * ) Notice: Subject to any disclaimer, the term of this patent is extended or adjusted under 35 U.S.C. 154(b) by 0 days.

(21) Appl. No.: 10/164,792

(22) Filed: Jun. 6, 2002

(65) Prior Publication Data

US 2003/0226576 A1 Dec. 11, 2003

(51) Int. Cl.[7] ..... B08B 3/10; B08B 5/04

(52) U.S. Cl. ..... 134/10; 134/12; 134/19; 134/21; 134/26; 134/30; 134/31; 134/36

(58) Field of Search ..... 134/10, 12, 21, 134/30, 31, 26, 36

(56) References Cited

U.S. PATENT DOCUMENTS 5,240,507 A 8/1993 Gray et al.
5,469,876 A 11/1995 Gray et al.
5,538,025 A 7/1996 Gray et al.
5,630,434 A 5/1997 Gray et al.
5,702,535 A 12/1997 Gray et al.
6,004,403 A 12/1999 Gray et al.
6,418,942 B1 7/2002 Gray et al.

*Primary Examiner*—Zeinab El-Arini
(74) *Attorney, Agent, or Firm*—Barlow, Josephs & Holmes, Ltd.

(57) ABSTRACT

The invention is directed to a controlled environment processing chamber into which solvents, water and/or gases can be introduced for cleaning of an object. The process includes first applying a negative gauge pressure to the chamber to non-condensable gases and then introducing a solvent, solvent mixture, water or gas in either a liquid or vapor state to remove soluble contaminants from the surface of an object being processed in the chamber. Further steps recover residual solvent or solution from the object and chamber. A secondary cleaning step directs a vapor state fluid at high velocity at a solid surface of the object to remove insoluble material left behind after the pretreatment step. A final series of steps recovers any loose impediments or residual liquid or vapor from the chamber and returns the chamber to atmospheric pressure for removal of the cleaned object.

16 Claims, 5 Drawing Sheets

METHOD FOR REMOVING PARTICLES AND NON-VOLATILE RESIDUE FROM AN OBJECT

BACKGROUND OF THE INVENTION

The present invention relates to a new method and system for removing particulate and non-volatile residue (NVR) from the surfaces of manufactured parts. More particularly the present invention relates to a method and system of high velocity fluid jetting for removing residues from the surface of high precision manufactured products such as computer chips and computer disk platters in a reduced pressure environment. The examples used describe methods for internal and external surface treatment and can be used in many industries, which require contaminant and particle free parts as part of their everyday manufacturing process.

In the computer chip manufacturing industry, cleaning and particle removal, prior to etching and deposition, is becoming more of a challenge because of the sizes and aspect ratios encountered during the manufacturing of chips for high-speed computers. Particle removal of particle sizes less than 0.2 microns is becoming more the normal requirement to ensure quality chips and the particle removal process is becoming more and more critical to the process success. Fluids are the preferred media used for particle removal from chips, however, hand wiping is now often required to attain the desired particle removal level. The problem with fluid removal methods is the need to produce significant fluid motion near the solid surface where the micron size particles reside. Even during periods of rapid fluid motion across a solid surface, a viscous sub-layer exists in which there is very little fluid motion. This viscous sub-layer actually acts as a dampener to turbulent eddies moving toward the surface which would normally remove the particles submerged in this fluid viscous sub-layer if not inhibited by this fluid barrier. These layers also dampen the fluid motion from energy release mechanisms such as that produced by ultrasonic transducers which generate energy from imploding vapor bubbles in the fluid at relatively remote regions from the solid surface and viscous sub-layer.

Generally speaking, as a fluid moves across a surface, a layer of slow moving fluid near the solid surface prevents significant fluid impact forces on the surface, and thus inhibits the natural particle removal mechanism. The slower the fluid motion, the larger the viscous sub-layer and the greater the dampening of eddy fluid impact on a particle residing in this sub-layer. This sub-layer also dampens the eddies produced by ultrasound which if produced at a relatively far distance from the surface, dissipate their energy before reaching the surface when encountering this barrier sub-layer. Indeed, in order to circumvent this dampening problem, increased sound wave frequency is used in order to produce bubbles closer to the sub-layer and the particles. However, this enhancement is often offset by the fact that smaller bubbles release lower energy when imploded.

The main problem with the above particle removal mechanisms is that the fluid motion generated from the release of energy from imploding bubbles or from fluid eddies generated in turbulent fluid motion needs to penetrate through a relatively stagnant viscous sub-layer of fluid in order to reach micron sized particles residing within this sub-layer on the surface. The fluid motion is dampened to a level at which the energy imparted to the particle is no longer sufficient to overcome the adhesive or van der Waals forces holding these particles to the surface. It would therefore appear that there is a need for a process that carries out the impacting of fluid motion as a particle removing process in the absence of atmospheric interference or in a highly reduced atmosphere of stagnant fluid.

SUMMARY OF THE INVENTION

In this regard, the present invention is directed to a controlled environment processing chamber or chambers into which solvents, water and/or gases used for processing a material can be introduced. The process includes a means of applying a negative gauge pressure to the chamber to remove air or other non-condensable gases. Means are provided for introducing a solvent, solvent mixture, water or gas in either a liquid or vapor state. A first step removes soluble contaminants from the surface of an object being processed in the chamber using solvent(s) or solution(s). Treatment may be in the form of etching, cleaning, stripping, dissolving, penetrating, vapor degreasing, submerging, spraying, ultrasonic treatment or any other process in which material is removed from a solid surface to a liquid or gas phase. A second step further recovers residual solvent or solution from the object and chamber in order to reduce the atmosphere in the chamber. A third step introduces a fluid preferably in gas or vapor form which is jetted into the chamber in a fashion so as to be directed at a solid surface which may require the removal of insoluble material left behind after a pretreatment clean. A fourth step recovers any loose impediments or residual liquid or vapor from the chamber and returns the chamber to atmospheric pressure to remove the cleaned object.

In another aspect of the invention, a method of processing an object in an enclosed solvent processing system, including a solvent supply system in sealable communication with a cleaning chamber comprises the steps of:

(a) sealing the solvent or solution supply system with respect to the chamber;

(b) evacuating the supply system of air and non-condensable gases and maintaining this air free environment;

(c) opening the chamber to atmosphere and placing an object to be processed in the chamber;

(d) evacuating the chamber to remove air and other non-condensable gases;

(e) sealing the chamber with respect to atmosphere;

(f) opening the chamber with respect to the solvent supply system and introducing a solvent or solution into the evacuated chamber;

(g) processing the object while maintaining an air free environment within the chamber;

(h) recovering and processing the solvent or solution introduced into the chamber within the closed circuit processing system;

(i) introducing the solvent or non condensable gas as a jet of liquid, gas or vapor to further process the object by mechanically removing residual insoluble material from the surface by impact or drag forces on that material;

(j) recovering and processing the $2^{nd}$ solvent or gas introduced into the chamber within the closed circuit processing system;

(k) repeating steps (i) and (j) as required;

(l) sealing the chamber with respect to the solvent supply system closed circuit solvent processing system;

(m) introducing air or other non condensable gases into the chamber for sweeping further solvent on the object and within the chamber; and (n) opening the chamber and removing the treated object.

The primary objective of the present invention is to provide an environment conducive to the removal of insoluble material from objects requiring surfaces that are free of foreign material before further processing of the object. Once an environment is created which is either free or substantially reduced of fluids normally encountered at ambient conditions, the invention provides for a means of impacting a jet of fluid on a surface for the purpose of mechanically scrubbing the surface of particles and other insoluble foreign residue.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

A method for reduced environment treatment of insoluble residue is described herein with examples teaching techniques for accomplishing the task on internal or external surfaces, using chambers or the part being cleaned as the chamber and examples of other mechanisms which are enhanced by operating the residue removal at lower pressures. The following examples of the present invention are being described for purposes of illustration and are not intended to be exhaustive or limited to the steps described or solvents used in the descriptions. The scope of the invention is wide and can cover many industries and processes as illustrated in the sample examples below.

Figure 1:
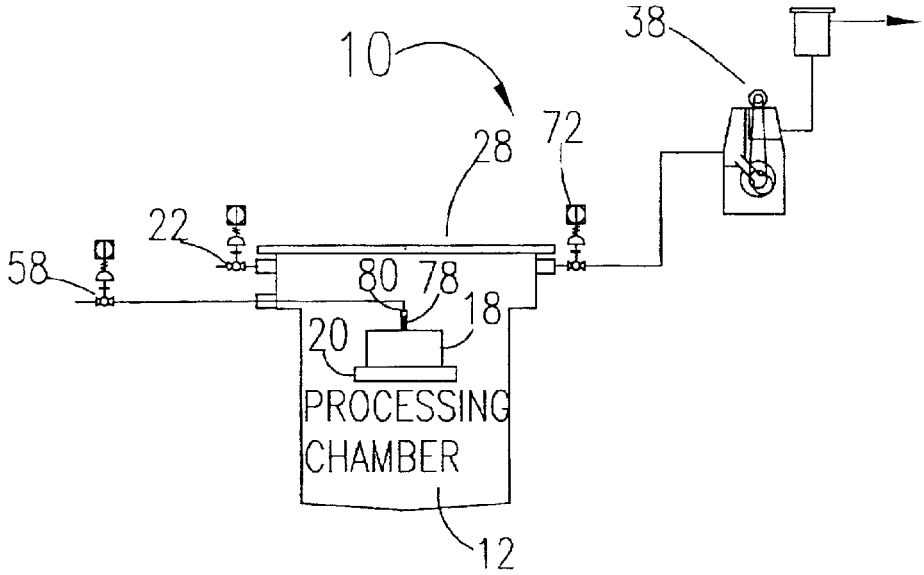
FIG. 1 is a schematic view of the preferred embodiment of the system of the present invention.

In the simplest form, the preferred embodiment of the present invention requires a vacuum pump and a processing chamber in fluid communication with each other. A depiction of the process is shown in FIG. 1. In FIG. 1, the process method 10 includes a processing chamber 12 having an object 18 requiring non volatile residue removal placed upon a support 20 fixedly mounted within the processing chamber 12. A valve 22, in fluid communication with the atmosphere and the processing chamber 12, is provided for selectively introducing air into the processing chamber 12.

The object 18 is placed into the processing chamber 12 on the support 20 through an opening created by removing a lid 28. After receiving the object 18, the lid 28 is secured to the processing chamber 12 wherein the processing chamber 12 is sealed. Valve 72 is opened and the air handling vacuum pump 38 is used to remove virtually all the air from the processing chamber 12.

After removal of all the air in the chamber 12, valve 58 is opened and ambient air is released into the chamber through nozzle 80 to produce a jet 78, which impinges on the surface of part 18. Because of a reduced atmosphere in the chamber, the first burst of air impinging on the lid surface spreads over a surface that is free of any fluid. Since no fluid exists near the surface, there is no boundary layer of fluid surrounding any particles or foreign residue on the surface and the leading edge of the spreading air will contact the particle at velocities well above those normally encountered in fully developed atmospheric boundary layers which dampen any fluid motion or eddies attempting to reach micron size particles on the solid surface. Because there is no boundary yet developed, due to the reduced pressure within the chamber 12, the spreading jet will impact the particles on the surface as well as produce a higher drag on the particles due to an undeveloped boundary layer. If valve 58 is left open, as the leading edge of air passes, the particles will become submerged within a boundary layer with the smaller particles eventually becoming submerged in viscous boundary layer as the boundary layer flow develops. It is therefore desirable to cycle valve 58 open and closed in order to alternate between reducing the atmosphere surrounding the particles and jetting a fluid, such as air, past the particles to impinge and remove them from the surface. Valve 72 can be left opened and vacuum pump 38 can be left on thus also moving any particles left suspended in the chamber 12, which may have been moved from the solid surface. These particles are so small that they generally are suspended in the air stream exiting the chamber 12 through the vacuum pump 38.

Figure 2:
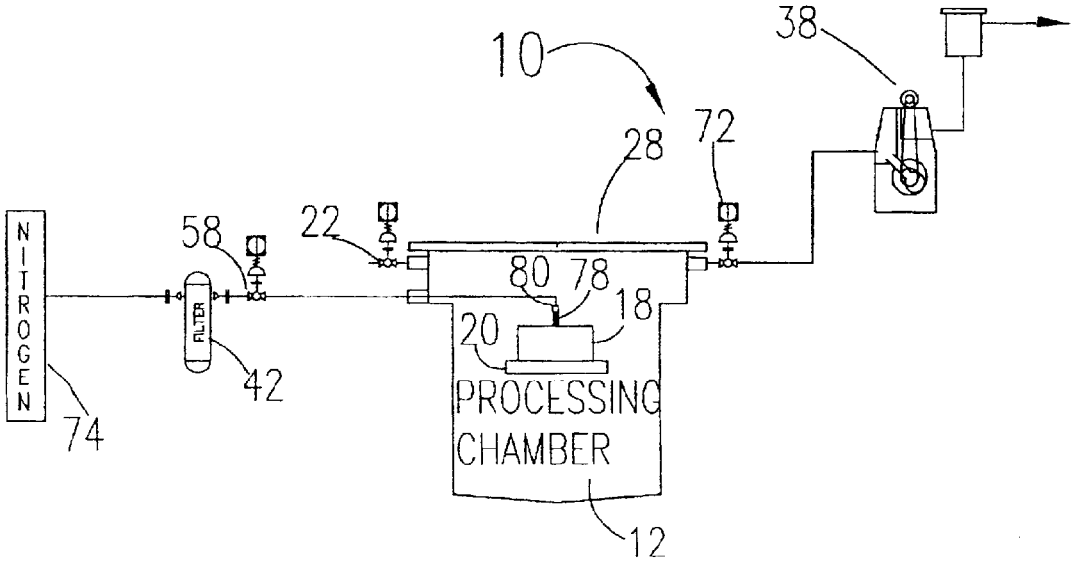
FIG. 2 is a schematic view of the present invention shown to include a source of jetted fluid.

The choice of jetting ambient air into the chamber 12 to remove small particles is only effective in clean room environments, since the injected air may deposit particles if the impinging air is not filtered well. It is therefore more practical, as shown in FIG. 2, to inject filtered air using filter 42 and even more effective to use compressed nitrogen from nitrogen source 74 in order to prevent the depositing of particles on the solid surface. It is obvious that other gases such as argon, helium and other noble and non-condensable gases would also be effective for the process. Condensable vapors or liquids can also be used such as halogenated cleaning solvents, deionized water, alcohols, esters, acids or any other liquids, which can be sprayed into a chamber. Subliming solids, such as solid carbon dioxide pellets or snow, would also be effective since the impacting solid would sublime to a gas which would spread over the surface as a gas as described above. As described above, the reduced pressure environment would also enhance the impacting effect of the solid pellets.

Figure 3:
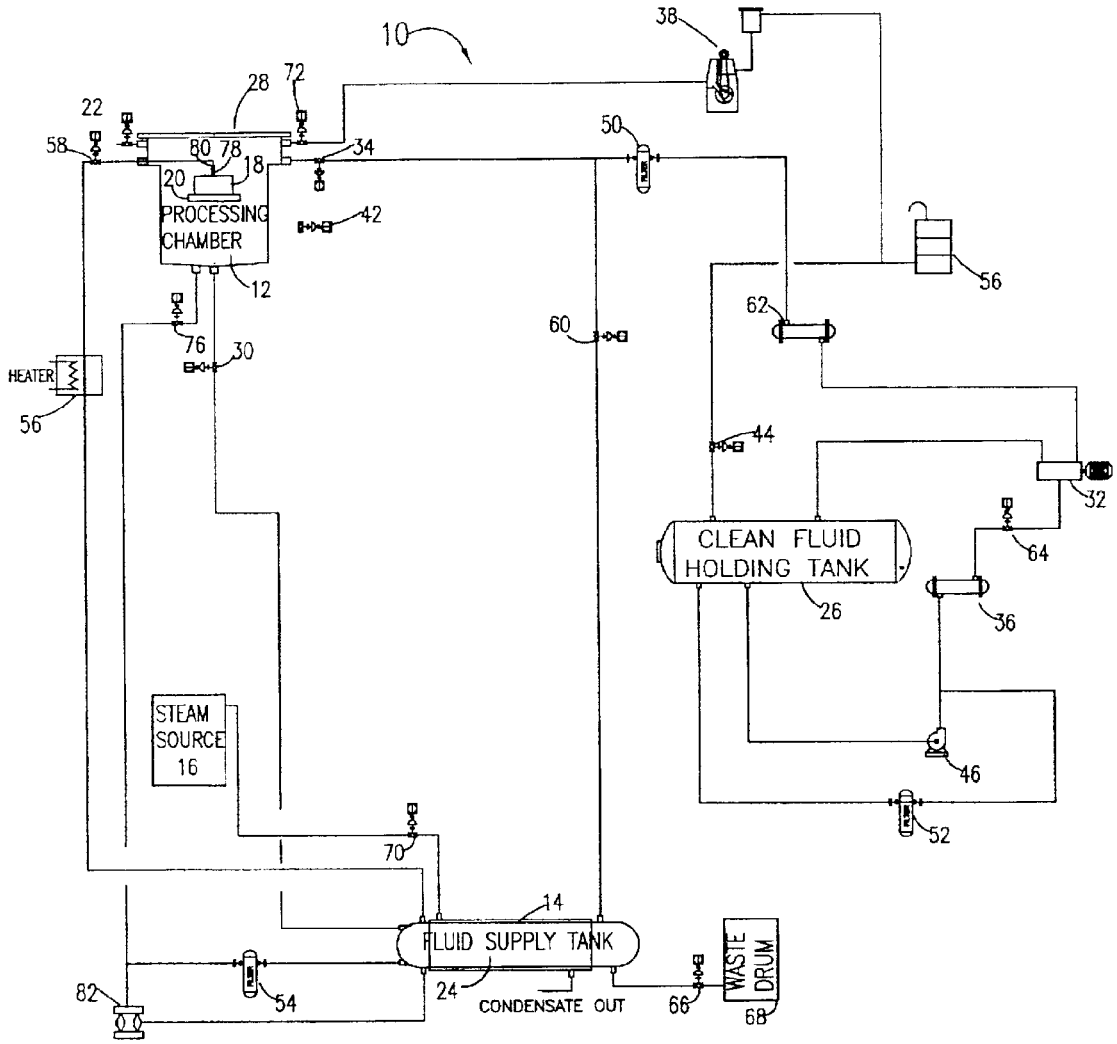
FIG. 3 is a schematic view of a an alternate embodiment thereof.

Generally to attain effective particle removal from a solid surface, a surface cleansing to remove contaminants on the surface, which may physically bond the particles to the surface, is usually performed. A liquid spray or soak or a vapor treatment can perform the cleansing. In a more practical method therefore, it is desirable to first contact the object with fluids which can dissolve or encapsulate residue which may act as adhesives to hold insoluble material on the solid surface. FIG. 3 therefore depicts a preferred embodiment of the reduced environment particle removal process.

In FIG. 3, the process method 10 includes a processing chamber 12 having an object 18 requiring cleaning placed upon a support 20 fixedly mounted within the processing chamber 12. A valve 22, in fluid communication with the atmosphere and the processing chamber 12, is provided for selectively introducing air into the processing chamber 12. The object 18 to be cleaned is placed into the processing chamber 12 on the support 20 through an opening created by removing a lid 28. After receiving the object 18, the lid 28 is secured to the processing chamber 12 wherein the processing chamber 12 is sealed. The air handling vacuum pump 38 is used to remove virtually all the air from the processing chamber 12.

An aqueous cleaning solution or solvent is preferably introduced to the processing chamber 12 as a heated liquid soak through pump 82 and valve 76. Typically, the solution can be circulated by opening the overflow valve 58 or drained and refilled by opening valve 30 and returning the solution to the fluid supply tank 24. The solution may be agitated as well as with jet pumps or spray nozzles on the inlet line through valve 76, or with ultrasonic transducers.

After the object 18 has been cleaned, any liquid solvent remaining in the processing chamber 12 is drained and/or pumped into the heated solvent vessel 24 by opening valve 30. The drained liquid will also remove most of the larger chips or lose insoluble material and transfer them to the heated solvent vessel 24.

Solvent vapors are next removed from the processing chamber 12 by means of a solvent handling vacuum pump 32. Specifically, valve 34 is opened and since there is no air present in this system, solvent vapors can be easily condensed in a heat exchanger 62 and the clean condensed solvent can be sent to the solvent holding tank 26 to be stored for reuse as clean spray for the next cleaning and rinse cycle. During this vapor-scavenging step, any residual solvent liquid remaining on the heated parts boils off the parts at the lower vacuum pressures, thus reducing solvent residual left in the vessel or on the parts.

Upon removal of solvent vapor and liquid from the processing chamber 12, non condensable gases are removed from the fluid supply tank 24 by means of the solvent handling vacuum pump 32. Specifically valve 60 is opened, vacuum pump 32 is activated, and non-condensable gases will be drawn from the tank 24 with the solvent vapors that are evaporating from the liquid in tank 24. As above, the solvent vapors can be condensed and gases cooled in a heat exchanger 62 and the clean condensed solvent can be sent to the solvent holding tank 26 to be stored for reuse as clean solvent for the next cleaning or rinse cycle. The cooled gases can be vented from the holding tank 26 and the system 10 through valve 44 preferably to a vapor recovery device such as a carbon drum 48 shown.

The solvent or solution is now preferably introduced to the chamber 12 from the fluid supply tank 24 as a heated vapor as through valve 58 in FIG. 3. Fluid supply tank 24 is heated by steam introduced into jacket 14 from steam source 16 when valve 70 is opened. Tank 24 can be heated by other conventional means such as electric heaters, oil jackets, and other conventional means used to heat and vaporize liquids in vessels. When fluid supply tank 24 has been heated to the desired temperature, valve 58 is opened and a vapor jet 78 of solvent or water will be injected into the chamber because of the pressure differential between the evacuated chamber 12 and the fluid-processing tank 24. The injected vapor is preferably directed to the solid 18 to be cleaned to produce an impact of vapor on the surface for moving particles along or off the surface of the object 18. The vapor jet is best directed by the use of a nozzle 80 as depicted in FIG. 3. The leading edge of the impinging jet should be most effective in imparting energy to any foreign matter on the surface since there is either no fluid present or very little atmosphere present thus allowing the injected vapor the reach the solid surface with little or no impediment. The rate of vapor jetting into the chamber will depend upon the size of the feed line and pressure drop across any fittings in the line, the level of vacuum in the chamber 12, and the amount of pressure in the fluid supply tank 24. The jetting process can therefore be controlled by the rate of heating of tank 24.

The impinging jet, after spreading and becoming removed from the surface of the object 18, should carry away particles or insoluble residue from the object 18. The vapor and particles will fill the chamber 12 slowing the impinging process. Smaller particles will remain suspended in the chamber while larger particles may fall to the chamber walls and bottom. After the chamber 12 has been filled with vapor and the pressure in the chamber 12 and the fluid tank 24 have equalized, valve 58 can be closed isolating chamber 12. Vapors can be removed by opening valve 34 and turning on vacuum pump 32. The vapors leaving the chamber 12 will carry most of the smaller particles with it and remove them from the chamber 12. The vapor can be passed through the condenser 62 and vacuum pump 32 and sent to holding tank 26 to possibly be reused for future processing. If the solvent is to be reused, it is advantageous to pass the vapors through the filter 42 as shown in FIG. 3. It is efficient to filter the solvent as a vapor rather than in the liquid phase in order to continuously remove particles from the system 10. Liquid in tanks 24 and 26 can also be filtered for reuse by circulating liquid with pumps 82 and 46 through filters 54 and 52 respectively.

In the case where the solvent is reused, the solvent in the fluid supply tank 24 is distilled to holding tank 26 through valve 60, through filter 44, through condenser 62 and through vacuum pump 32. Distilling is accomplished by heating the vessel 24 with steam entering jacket 14 through valve 70 from steam source 16.The residue left behind after distilling is discharged through open valve 66 to waste drum 68 removing particles with the waste as well.

For a more strenuous, continuous particle removal process, the injection of vapor into the chamber 12 through valve 58 can be in very short bursts, when valve 58 is rapidly cycled open and shut. Simultaneously vapor can be continuously removed through valve 34, filter 42, condenser 62 and vacuum pump 32 in order to maintain a very low content of solvent vapor and a low pressure within the chamber 12 and around the surface of the object 18. Rapidly cycling the opening and closing of valve 58 provides intermittent bursts of vapor striking the object 18 surface. Also, the continuous removal of vapor reduces the concentration of small particles circulating in the chamber and thus reduces the probability and frequency of particles re-depositing on the object 18. In order to prevent the condensing of vapors on the object 18, which could provide a liquid film over the surface of object 18, the jetting vapors may be preheated with an electric heater 56 shown in FIG. 3.

Figure 4:
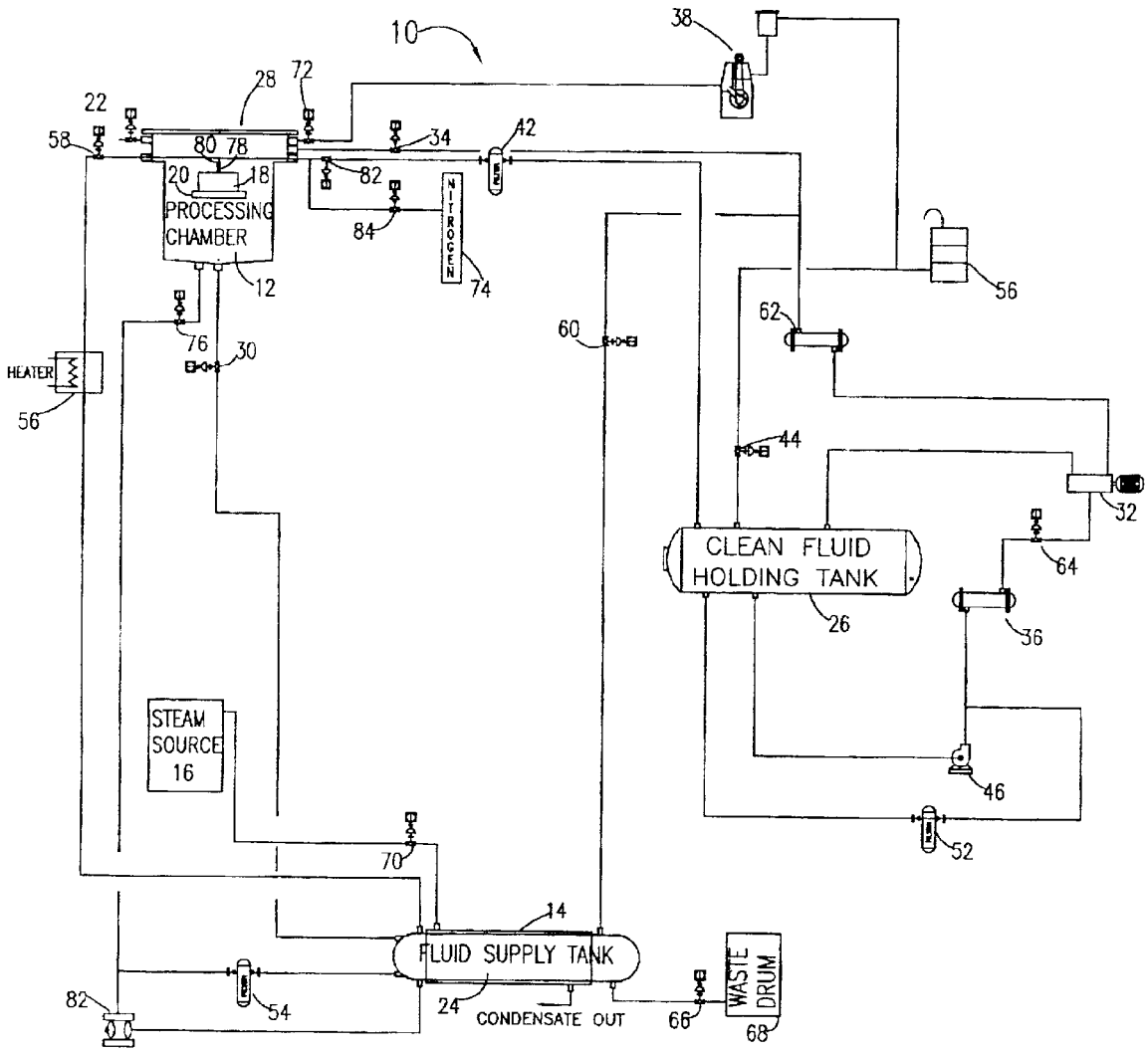
FIG. 4 is a schematic view of a second alternate embodiment thereof.

There may be instances where jetting a non-condensable gas is more effective than jetting a vapor. FIG. 4 shows a process 10 in which air, recycled within the process, is used to jet onto the surface of object 18. After cleaning the object 18 as described above, valve 82 is opened and air from holding tank 26 is passed through filter 42, open valve 82 and nozzle 80 to form a jet of air 78 impinging on the surface. The impinging air is removed from the chamber 12 through valve 34, through condenser 62, through vacuum pump 32 and back to holding tank 26. As above, the process can be cycled by opening and closing valve 82. For cleaner gases, after the chamber 12 has been evacuated of any vapors or liquids, pressurized gases such as nitrogen source 74 or solid carbon dioxide can be jetted onto the surface as above, however this gas can be evacuated from the system 10 through open valve 74 to the atmosphere using air handling vacuum pump 38. The gases can be scrubbed in a filter 48 such as depicted in the FIG. 4.

Figure 5:
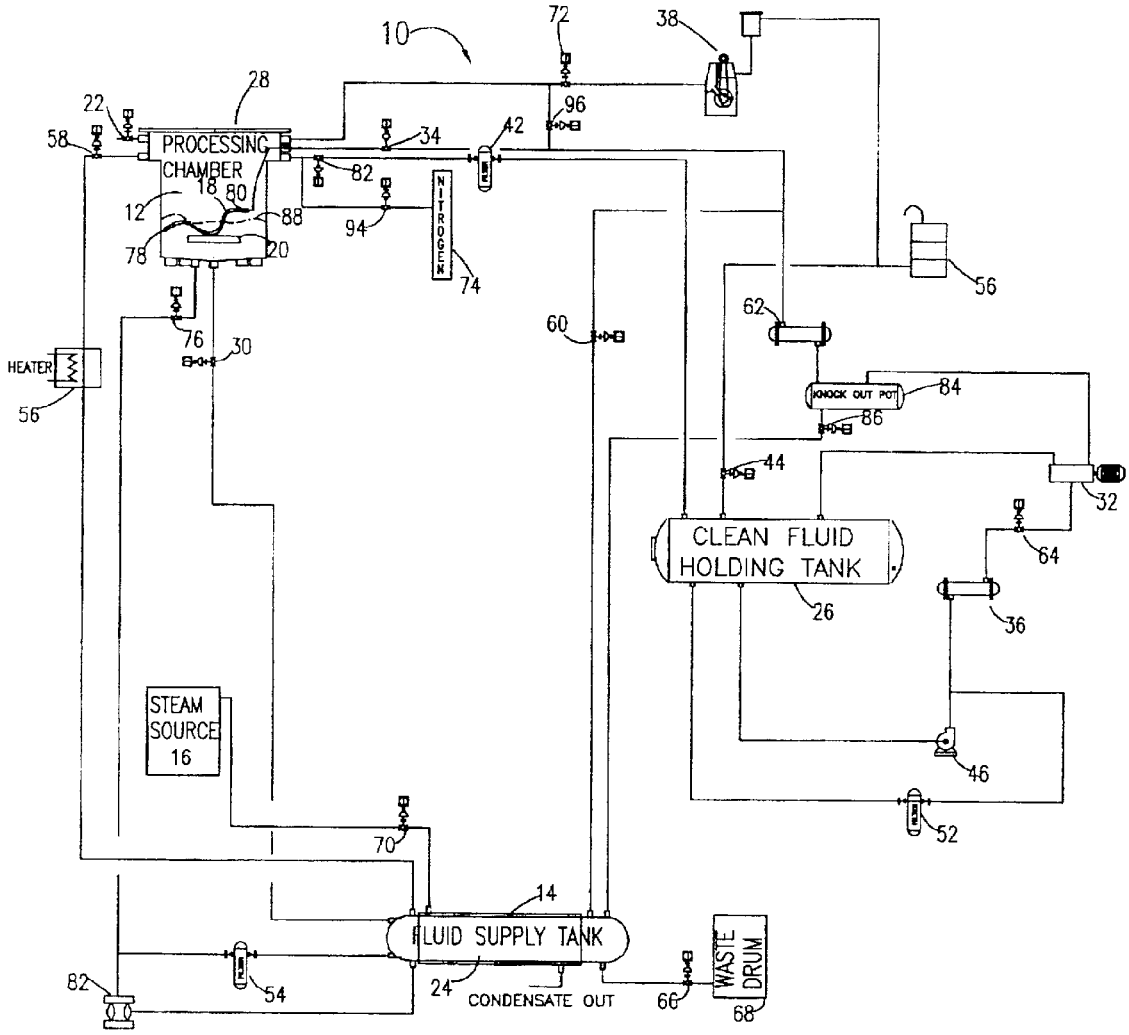
FIG. 5 is a schematic view of a second alternate embodiment thereof.

The above processes are examples of methods that can be used to remove particles from external surfaces. It often becomes a requirement to remove particles from the internals of parts such as often occurs in medical devices. FIG. 5 shows a tube 18, which will be used here as an example of a part being cleaned internally by the invention. In this method, one end of the part 18 is attached to a hose or tube, which is in fluid communication with a vacuum source such as vacuum pump 32 through open valve 34 and condenser 62. In the preferred embodiment, the tube is cleaned as above in a vacuum. In the initial step, chamber 12 is evacuated of non-condensable gases by vacuum pump 38 through valve 72. Fluid introduced using pump 82 through valve 76, if pumped to submerge tube 18, will fill the tube 18 because of the vacuum on the inside of the tube and dissolve soluble contaminant from the inside tube walls. Upon closing valve 76 and opening valve 30, the fluid in chamber 12 will gravity drain to fluid supply tank 24, removing the bulk of fluid from tube 18. It can be expected that some insoluble residue can be removed from the tube 18 by the treatment method above, however it would be expected that if particles are present, that a significant quantity of the particles would remain in the tube along with a significant amount of trapped fluid if the tube were bent as depicted in FIG. 5.

It is therefore advantageous to move fluid through the tube at a steady rate to physically move particles through the tube and out of the tube 18 to a side reservoir. The conventional way of accomplishing this is to attach an external line to the tube 18 and pump cleaning fluid through the tube. In this invention, it is desired to pull the fluid through the tube 18 in order to move the fluid through the tube 18 in a simpler and more efficient manner.

In FIG. 5, after fluid from the fluid supply tank 24 is pumped to a fluid level 88 which is above the tube opening 78, fluid can be drawn through the tube 18 by opening valve 34 and turning on vacuum pump 32. If valve 86 remains closed, knockout pot 84 will be evacuated and if valve 88 is opened, air from clean fluid tank 26 will slightly pressurize chamber 12, pushing fluid through the tube 18, through connector 80, through valve 34, through condenser 62 and into knockout pot 84. This process can continue if pump 82 delivers enough fluid from fluid supply tank 24 to keep the fluid level 88 above tube opening 78.

The pulling of fluid through the tube pushes the tube 18 against the coupling 80, which helps prevent the coupling 80 from separating from the tube 18, a problem often encountered when using the conventional means of pushing the fluid through the tube as with a pump. Generally the bulk of the larger particles can be removed from the interior of the tube 18, however, as mentioned above, smaller particles can remain on the surface in the slower moving viscous boundary layer. It can be advantageous, especially for tubes, which can pass sound waves through tube walls such as plastics, to apply ultrasonics to the fluid using ultrasonic transducers 90 as depicted in FIG. 5. In tubes in which fluid is being pushed, the ultrasonic bubbles cannot grow significantly since the fluid in the tube 18 is under pressure. Smaller ultrasonic bubbles do not produce significant energy generation upon implosion and therefore ultrasonic waves are not effective. Using the invention method of pulling the fluid through the tube 18 produces a low pressure in the tube 18. Applying ultrasonic waves to this fluid generates a greater number, faster growing, larger vapor bubbles which release greater energy when imploded. The reduced pressure environment in the tube 18 therefore enhances the capability of the ultrasonics.

Controlling the temperature of the fluid and the level of the non-condensable gases introduced to the chamber 12 can control the above enhancement of ultrasonic cleaning and NVR removal by allowing an adjustment to the pressure at which the ultrasonics can be applied. Opening the valve 96 in FIG. 5 would draw non-condensable gases from the chamber 12 reducing the operating pressure for ultrasonic processing while opening valve 82 would introduce more non-condensable gases to increase the operating pressure. The operating pressure would be between the vapor pressure of the liquid in the vessel 12 and atmospheric pressure. Higher operating pressures are attainable by adding a gas-pressurizing device such as a compressor between clean fluid tank 26 and valve 82. Too high a pressure results in less vapor bubble generation and smaller bubbles, while low pressures may result in vapor bubbles escaping to the vapor state without collapsing and releasing energy to the fluid. The most effective pressure to operate at depends upon the frequency and energy level of the ultrasonics as well as the fluid temperature and solvent properties such as boiling point and latent heat of vaporization. The optimum ultrasonic operating pressure of the chamber 12 for particle removal on the inside of the tube 18 should be different than that for cleaning the outside of the object since the fluid on the internals of the object 18 are exposed to a more direct vacuum and are thus moving at a greater velocity, resulting in a fluid at a lower pressure than the fluid in the chamber 12. Varying the pressure throughout the particle removal cycle, in order to clean both the inside and outside of the object 18 would enhance the overall process.

After moving cleaning fluid through tube 18, the tube and chamber 12 can be drained of all the fluid by opening valve 30 and sending the fluid to the fluid supply tank 24. The fluid in knockout pot 84 can also be returned to fluid supply tank 24 by opening valve 86 and draining knockout pot 84. If valves 30, 82, and 86 are closed and valve 34 is opened and vacuum pump 32 is on, vapor and residual air will pass through tube 18, through valve 34, through condenser 62 and knockout pot 84, and through vacuum pump 32 to be sent to clean fluid holding tank 26. The movement of heated vapor and air through the tube will dry the tube since the hot vapor will enter a lower pressure area in the tube 18 from the higher pressure area in chamber 12 and become superheated and capable of providing heat for drying. Additional heated vapor can be introduced to the chamber 12 by opening valve 58 and can be superheated by heater 56 if additional heat is required. As compared to conventional drying, which either blows air on the outside of the tube or blows pressurized air through the tube, the vacuum drying method in this invention is more effective since the solvent will evaporate from the surface at a much lower temperature due to the lower pressure in this invention.

For enhanced particle removal, after drying the tube 18 as done above, valves 82 and 58 can be closed and the vacuum can be pulled to a low pressure. Once the chamber 12 has reached a low pressure, valve 58 can be opened and vapor will rapidly fill the chamber 12 and jet through the tube 18 as vacuum pump 32 continues to pull vacuum through valve 34 and connector 80. Similar to the process discussed above for exterior surfaces, the initial jet of vapor entering the tube 18 either does not encounter an established fluid boundary layer or encounters a low atmosphere boundary layer which can easily be penetrated to contact any insoluble residue left behind on the surface and remove these particles from the tube 18. Also as above, opening and closing the valve 58 produces a pulsing action to enhance the removal. Similar to this vapor process, non-condensable gases can be used as described for exterior surfaces above. If valve 82 is opened rather than valve 58, air from, clean fluid tank 26 can be injected into the chamber 12 and jetted through tube 18. Any remaining particles after cleaning will be carried from the tube 18, through valve 34, through condenser 62 and knock-out pot 84 and through vacuum pump 32 to be sent to the holding tank 26. As with exterior surfaces, if clean gases are preferred, compressed gases such as nitrogen or solid carbon dioxide pellets can be sent to chamber 12 through valve 94. This gas is best removed using an air pump 38 through valve 72 while keeping valve 34 closed. Also as mentioned, in the preferred embodiment, valve 94 would be cycled opened and closed to enhance the jetting effect on the particles on the surface.

Figure 6:
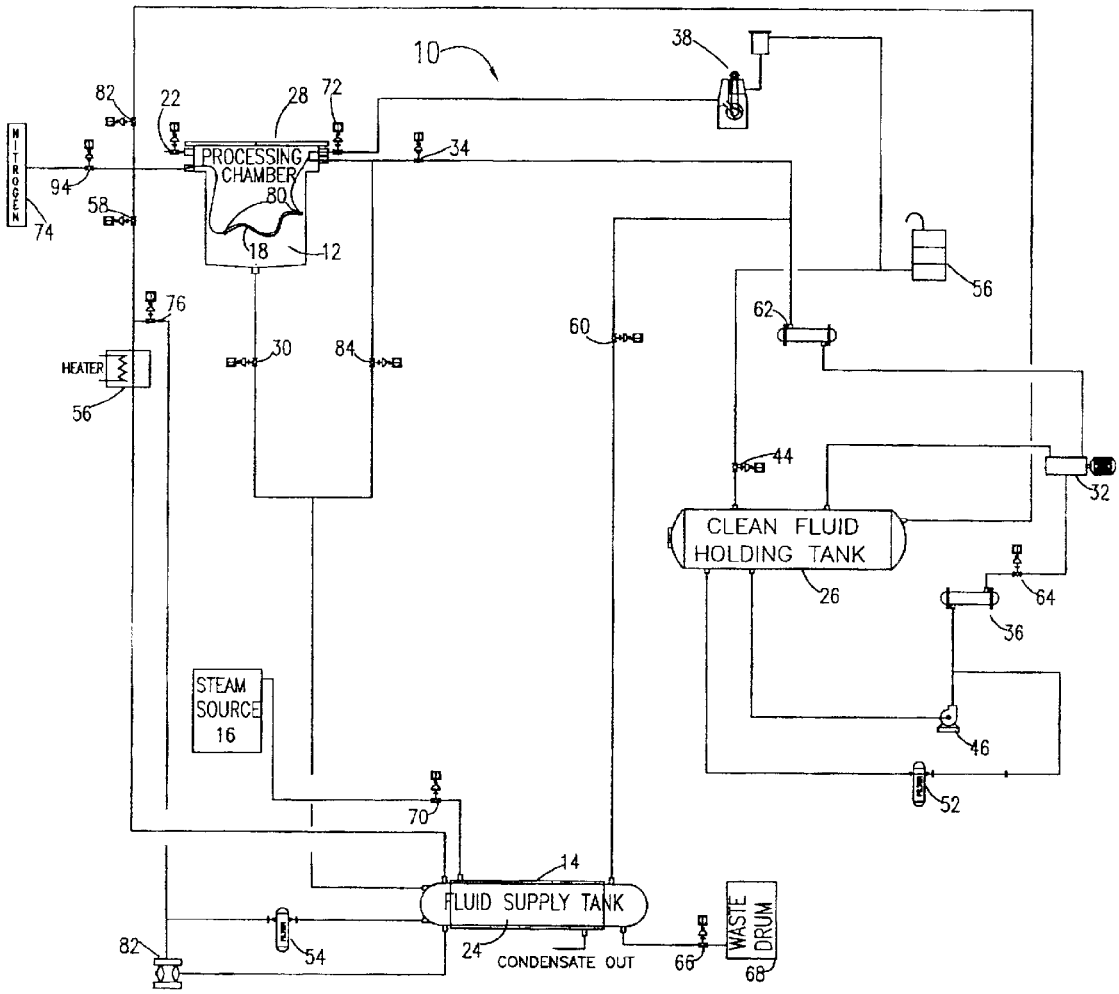
FIG. 6 is a schematic view of a third alternate embodiment thereof.

For a more controlled residue removal environment, interior surfaces can be connected at the inlet and outlet sides of the object 18 as depicted in FIG. 6. Under these conditions, the object itself can act as the cleaning chamber minimizing the volume that would need to be kept particle free. The chamber 12 may be required for either exterior treatment of the object 18 or solvent containment for hazardous solvents however in this embodiment, it is not necessary.

In the preferred embodiment, the inside surface of the tube 18 can be treated with heated liquid solvent to clean the inside surface by opening valve 76 and valve 84 and turning on pump 82. After circulating solvent from fluid supply tank 24, through part 18 , back to tank 24 and cleaning the object, which is connected at the inlet and outlet to exterior piping using connectors 80, valves 76 and 84 can be closed and the inside surface of the tube 18 can be treated with heated vapor by opening valve 58 and jetting vapor heated in heater 56 into tube 18. Vapor and liquid exiting the tube passes through open valve 34, condenser 62, through pump 32 would be collected in clean fluid holding tank 26. In a similar manner, air can be jetted into the tube by opening valve 82 and recycling air stored in clean fluid tank 26 through the system as just described for heated vapor. If clean fresh nitrogen or other non-condensable gas is used as would be jetted into tube 18 in FIG. 6 by opening valve 94, the gas would best be removed using vacuum pump 38 through open valve 72 and scrubbed in carbon drum 56 prior to release to the environment. Multiple treatment can be performed by cycling the inlet valve open and closed or by alternating the treatment fluid by alternating the opening of valve 58, valve 82 and valve 94 after full evacuation of the previous treatment fluid to treat the tube with vapor, recycled air and clean bottled gas, respectively.

The above examples of the present invention have been described for purposes of illustration and are not intended to be exhaustive or limited to the steps described or solvents and gasses used in the descriptions. The scope of the invention is wide and can cover many industries and processes as illustrated in the sample examples stated. It will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A method of removing non-volatile solvent residue in a closed circuit processing system, said system including a chamber, a first fluid supply tank in communication with said chamber and a second fluid supply tank in communication with said chamber, said method comprising the steps of:

placing an object to be processed in a chamber;

sealing said chamber;

evacuating non-condensable gasses from said chamber; to create an evacuated condition;

introducing a first fluid into said evacuated chamber from a first fluid supply tank to clean said object contained in said chamber;

recovering and retaining said first fluid from said chamber whereby said chamber is returned to said evacuated condition;

heating a second fluid to a heated vapor state;

directing said second fluid at a high velocity against the surface of said object to dislodge said non-volatile residue from the surface of said object;

recovering and retaining said second fluid from said chamber whereby said chamber is returned to said evacuated condition;

introducing a non-condensable gas to said chamber to return said chamber to atmospheric pressure; and opening said chamber and removing said object.

2. The method of removing non-volatile residue from an object in claim 1, wherein said step of reducing the pressure within said chamber comprises reducing the pressure to between atmospheric pressure and zero absolute pressure.

3. The method of removing non-volatile residue from an object in claim 1, wherein the method used in the step of introducing said first fluid into said chamber is selected from the group consisting of: liquid spray and liquid soak.

4. The method of removing non-volatile residue from an object in claim 1, wherein the fluid state of said first fluid during the step of introducing said first fluid into said chamber is selected from the group consisting of: vapor, gas-vapor mixture and aerosol spray.

5. The method of removing non-volatile residue from an object in claim 1, wherein said first fluid and said second fluid are the same fluids.

6. The method of removing non-volatile residue from an object in claim 1, wherein said second fluid is selected from the group consisting of: recycled air, clean air, nitrogen, carbon dioxide pellets and non-condensable gas.

7. The method of removing non-volatile residue from an object in claim 1, wherein said steps of recovering and retaining said first and second fluids from said chamber further comprise:

withdrawing a first portion of said first and second fluids from said chamber in a liquid state; and withdrawing the remaining portion of said first and second fluids from said chamber in a vapor state.

8. The method of removing non-volatile residue from an object in claim 7, wherein said step of withdrawing said first and second fluids in a vapor state further comprises:

reducing the pressure in said chamber causing said first and second fluids to flash to form a vapor; and withdrawing said vapor from said chamber.

9. The method of removing non-volatile residue from an object in claim 1, wherein said steps of recovering and retaining said first and second fluids includes filtering the first and second fluids to remove particles and other non volatile residue prior to condensing said first and second fluids to the liquid state.

10. The method of removing non-volatile residue from an object in claim 1, wherein said second fluid is directed at the surface of said object using a jet nozzle, said jet nozzle being cycled on and off to create alternating fluid jetting and low pressure environments at the surface of said object.

11. A method of removing non-volatile solvent residue in a closed circuit processing system, said system including a chamber and a fluid supply tank in communication with said chamber, said method comprising the steps of:

placing an object to be processed in a chamber;

sealing said chamber;

evacuating non-condensable gasses from said chamber;

introducing a fluid to said evacuated chamber from said fluid supply tank to clean said object contained in said chamber;

recovering and retaining said fluid from said chamber;

heating said fluid to a heated vapor state;

directing said heated vapor state fluid at a high velocity against the surface of said object to dislodge said non-volatile residue from the surface of said object;

recovering and retaining said fluid from said chamber;

introducing a non-condensable gas to said chamber to return said chamber to atmospheric pressure; and opening said chamber and removing said object.

12. The method of removing non-volatile residue from an object in claim 11, wherein said step of reducing the pressure within said chamber comprises reducing the pressure to between atmospheric pressure and zero absolute pressure.

13. The method of removing non-volatile residue from an object in claim 11, wherein the method used for directing said heated vapor state fluid is selected from the group consisting of: liquid spray, liquid soak, vapor spray, gas-vapor mixture and aerosol spray.

14. The method of removing non-volatile residue from an object in claim 11, wherein said steps of recovering and retaining said fluid from said chamber further comprise:

withdrawing a first portion of said fluid from said chamber in a liquid state; and withdrawing the remaining portion of said fluid from said chamber in a vapor state.

15. The method of removing non-volatile residue from an object in claim 14, wherein said step of withdrawing said fluid in a vapor state further comprises:

reducing the pressure in said chamber causing said fluid to flash to form a vapor; and withdrawing said vapor from said chamber.

16. The method of removing non-volatile residue from an object in claim 11, wherein said heated vapor state fluid is directed at high velocity using a jet nozzle, said jet nozzle being cycled on and off to create alternating fluid jetting and low pressure environments at the surface of said object.

* * * * *